United States Patent [19]

Regenstein

[11] 4,411,142

[45] Oct. 25, 1983

[54] ELASTIC YARN SUPPLY PACKAGE

[75] Inventor: Klaus J. Regenstein, Willich, Fed. Rep. of Germany

[73] Assignee: E. I. Du Pont de Nemours & Co., Wilmington, Del.

[21] Appl. No.: 398,224

[22] Filed: Jul. 14, 1982

[30] Foreign Application Priority Data

Jul. 24, 1981 [DE] Fed. Rep. of Germany ..... 3129350

[51] Int. Cl.[3] ..... D04B 7/04

[52] U.S. Cl. ..... 66/196; 66/202; 28/218

[58] Field of Search ..... 28/218; 66/196; 6/195, 6/197, 202; 139/116

[56] References Cited

U.S. PATENT DOCUMENTS

| | | | |
|---|---|---|---|
| 3,540,492 | 11/1970 | Houwing | 139/116 |
| 3,542,084 | 11/1970 | Ruppreht et al. | 139/116 |
| 3,827,261 | 8/1974 | Rupprecht | 66/195 |
| 4,307,587 | 12/1981 | Baesgen et al. | 66/202 X |

OTHER PUBLICATIONS

Paling, "Warp Knitting Technology", Columbia, Englang, 1972, p. 216.

*Primary Examiner*—Ronald Feldbaum

[57] ABSTRACT

An improved elastic yarn supply package is provided in the form of a double-face, warp-knit tape from which the elastic yarns can be unravelled for feeding to subsequent fabric-making operations. The improved package, which is readily spittable into narrower tapes, has repeating stitch patterns whose underlaps do not cross each other or run in opposite directions between wales.

8 Claims, 2 Drawing Figures

ELASTIC YARN SUPPLY PACKAGE

BACKGROUND OF THE INVENTION

1. Field of the Invention

This invention relates to a supply package of elastic yarns in the form of a double-face, two thread-system, warp-knit tape from which the elastic yarns can be unravelled. In particular, the invention concerns such a supply package which, because of its specific knit structure, is easy to unravel and split into narrower tapes.

2. Description of the Prior Art

U.S. Pat. No. 3,827,261 discloses an elastic-yarn supply package in the form of a flat, deknittable tape, which is produced on a warp-knitting machine, such as a Raschel machine, having two needle bars and two fully threaded guide bars. Nonknitted ends of the elastic yarns hang out of one end of the tape. Pulling on the nonknitted ends causes the knitted stitches of the tape to unravel (i.e., deknit). The thusly unravelled yarns then may be fed to a fabric-making machine or other textile operations, such as yarn covering, core spinning, and the like. Monofilament yarns, preferably of spandex polymer, are disclosed.

The elastic yarn supply package of U.S. Pat. No. 3,827,261 is a double-face, two thread-system, warp-knit tape. Adjacent wales of the tape are located such that one wale is on one face of the tape and the adjacent wale is on the other face of the tape. The yarns from every other wale on one face of the tape combine their loops in the intervening wale on the other face of the tape. Each needle stitch is formed of two yarns, one from each of the two thread systems, i.e., one from each of the two guide bars. Underlaps of the two thread system cross each other and run in opposite directions between adjacent wales. In conventional Raschel-machine lap notation, the disclosed construction can be designated as 2-4, 2-0/2-0, 2-4. Conventional lap notation, as given in D. F. Paling, *Warp Knitting Technology*, Columbine Press, Great Britain (1970) page 216, is used throughout the present application.

Elastic yarn supply packages of the above-described type have been used commercially. However, such packages have several shortcomings. In particular, the packages are difficult to split along wales. This lack of splittability can result in waste because the number of elastic yarns in the package usually does not correspond to the exact number of ends required for the variety of subsequent fabric-forming operations that may be desired. If a supply package could be split readily along wales, narrower tapes having the exact number of ends required for the next operation could be separated from the package and the remaining portion of the package could be saved for later or different uses, thereby avoiding waste.

The known supply package suffers additional shortcomings because of its particular stitch construction. This construction, which provides only two ends in each wale, limits the rates at which the packages can be produced. Furthermore, the supply packages are known only with heavy denier elastic threads. Applicant has found that if fine denier elastic threads are used with the warp-knit construction of the known packages, difficulties are encountered in dividing the unravelled wales into individual ends.

In view of the above, the purpose of this invention is to provide an elastic yarn supply package that is easier to split and deknit, has an increased number of ends per wale, and is capable of being manufactured efficiently and used satisfactorily with elastic filaments of fine denier.

SUMMARY OF THE INVENTION

The present invention provides an improved elastic yarn supply package of the type that is in the form of a double-face, two thread-system, warp-knit tape from which the elastic yarns may be unravelled. The knit construction of the tape consists essentially of basic stitch patterns which are no more than two wales wide and preferably repeat themselves within every two courses. In the improved tape of the invention, there is an absence of crossovers of the underlaps of the two thread systems. The underlaps do not run in opposite directions between adjacent wales. In a preferred tape of the invention, the repeating stitch patterns are provided by one thread system forming open, one-needle pillar stitches and the other thread system forming closed 1 and 1 laps. In still another embodiment, each end in at least one of the thread systems includes a plurality of low denier spandex strands.

The invention also includes a process for making the improved elastic yarn supply package. The process is of the type that includes warp-knitting a tape on a two needle-bar machine having at least two fully threaded guide bars which are controlled to form basic stitch patterns of no more than two needle spaces wide and which preferably repeat within no more than every two courses. According to the invention, the movement of the guide bars is further controlled so that the underlaps of the stitches from the different thread systems do not cross each other. In a preferred process, each guide of at least one of the guide bars is threaded with two or more low denier spandex strands.

BRIEF DESCRIPTION OF THE DRAWINGS

The invention will be better understood by referring to the drawings, in which.

DETAILED DESCRIPTION OF PREFERRED EMBODIMENTS

Figure 1:
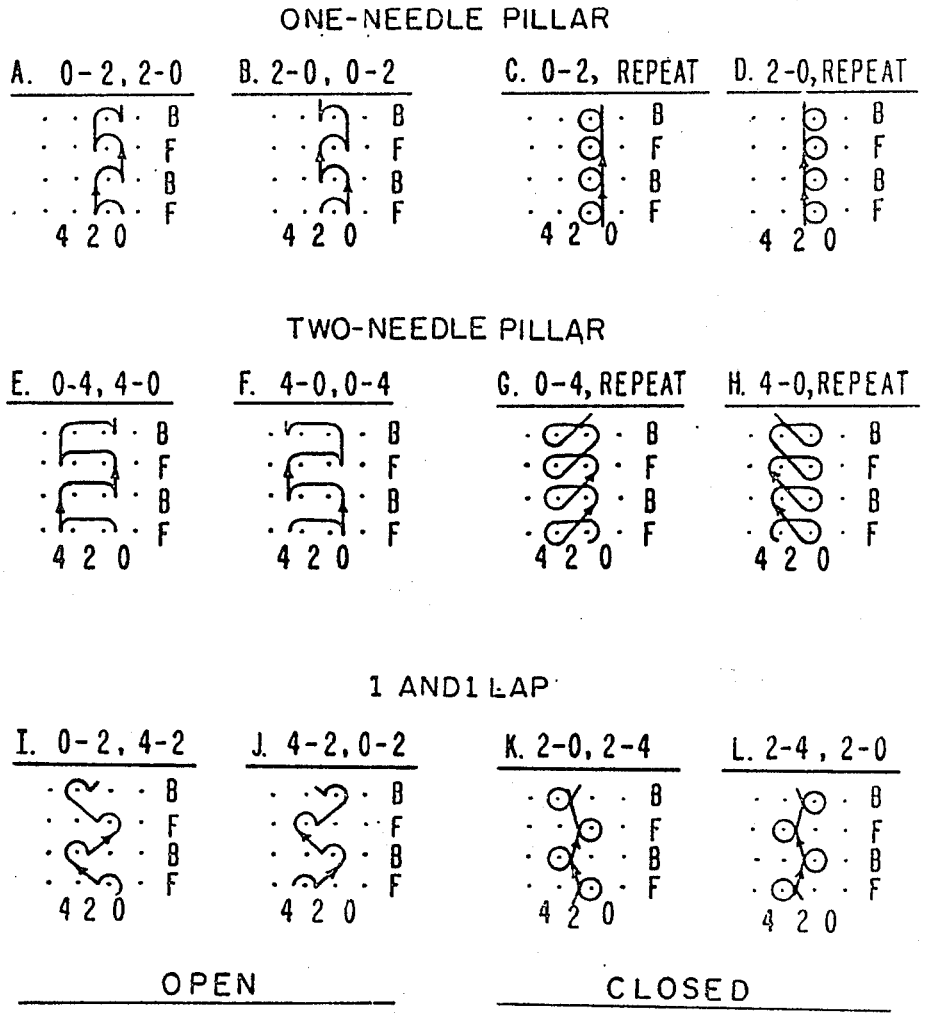
FIG. 1 depicts the lap diagrams for various repeating stitch patterns that are suitable for use in knitting the improved elastic thread supply packages of the present invention and FIG. 2 depicts individual and combined lap diagrams for a preferred knitted supply package of the invention.
Figure 2:
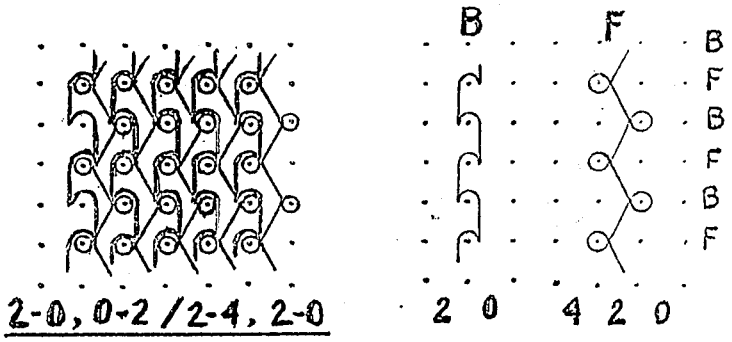

In each of the lap diagrams of FIGS. 1 and 2, the "F" and "B" located at the right-hand side of the diagrams, respectively represent the front needle bar and the back needle bar of a two needle-bar warp-knitting machine, such as a Raschel. "B" and "F" at the top of the lap diagram of FIG. 2 refer to the back and front guide bars, respectively. The Arabic numerals represent the conventionally numbered, from right to left, spaces between needles. The arrows in the lap diagrams of FIG. 1 indicate the direction that the underlaps of the stitches travel from one course to the next. The underlap is the portion of the stitch that connects the feet of needle loops between courses. In some knitting literature, underlaps are referred to as "sinkers" or as "floats." Lap diagrams A through D depict one-needle pillar stitches, also called chain stitches. Diagrams E through H depict two-needle pillar stitches, also called two needle chain stitches or "twill pillar" stitches. Diagrams I through L depict 1 and 1 laps, also called "tricot" laps. For each of the three types of stitch patterns, the two diagrams to the left of the center of the figure show the pattern with open stitches and the two diagrams to the right show the pattern with closed stitches. Note also that each repeating pattern is no more than two needle-spaces (i.e., two wales) wide. Generally open stitches are preferred for easy unravelling and closed stitches are preferred for more compact tapes.

The basic stitch patterns shown in FIG. 1 are formed by at least two guide bars knitting elastic yarns alternately on the front and back needle bars of a two needle-bar warp-knitting machine. The stitches are selected so that the underlaps of the stitches formed by one guide bar do not cross and run in the opposite direction of the underlaps of the stitches formed by the second guide bar. The table below lists the stitch patterns of FIG. 1 that can be used together, one made by one guide bar, and the other made by the second guide bar, to form warp-knit supply packages of the present invention. In these warp-knit supply packages, the absence of underlap crossovers and the limiting of the repeat patterns to widths of no wider than two wales are believed to provide the supply packages with better splittability along wales and easier unravelling and separation of elastic threads than were possible with the prior art warp-knit supply packages. For simplicity of fabrication, stitch patterns that repeat within every two courses are preferred. Furthermore, it is believed that if stitches from each guide bar do not run in opposition (i.e., the stitches are formed by the guide bars shogging in the same direction), a preferred yarn supply package is obtained which is easier to unravel and split.

TABLE

STITCH PATTERN COMBINATIONS
(Refer to FIG. 1)

| First Guide Bar | Second Guide Bar |
|---|---|
| One-needle pillar (A or B or C or D) | Any of E through L |
| Open two-needle pillar (E or F) | Any of A through L, including E or F |
| Closed two-needle pillar (G or H) | Same as on first guide bar or any of A through F |
| 1 and 1 laps | |
| I or K | Any of A through F, or I or K |
| J or L | Any of A through F, or J or L |

In contast to the above-listed knit constructions of the invention, if the 1 and 1 laps K and L of FIG. 1 were used, K on one bar and L on the other bar, the supply packages of U.S. Pat. No. 3,827,261, with its crossovers of underlaps between wales, would be obtained. Crossed underlaps also would be obtained if the two bars were threaded to provide stitches G on one bar and H on the other, or stitches I on one and J on the other, or J on one and K on the other, etc. The crossover of underlaps is a characteristic of warp-knit supply packages that are difficult to split and separate.

In the present invention, one-needle pillar stitches and open two-needle pillar stitches are particularly useful because they form underlaps that do not cross from one wale to another. In some knitting texts, such underlaps are called "vertical floats." When such underlaps are formed by one guide bar and the other guide bar is used to form any of the other stitch patterns shown in FIG. 1, there is no possibility of underlaps crossing each other or underlaps running in opposite directions.

It should be noted that if one-needle pillar stitches are formed by both guide bars, of course, no fabric results because of the lack of connections between wales. If one-needle pillar stitches are used, at least one guide bar of the warp knitting machine must provide a compatible two-needle stitch.

When different stitch patterns are formed by each guide bar, it is necessary to adjust the runner length for each guide bar so that equal lengths of the elastic yarn (i.e., measured in the nontensioned condition) will be delivered from each wale when the yarns are unravelled. Thus, in the warp-knit supply package, one-needle pillar stitches will be knit at lower tension (i.e., lower stretch) than, for example, 1 and 1 laps or than two-needle pillar stitches. Equal lengths of elastic yarn from each wale are essential for uniform delivery to a fabric-forming machine and contribute to ease of unravelling and separating the supply package into individual elastic threads.

It is preferred that two or more elastic strands be threaded in each guide of at least one of the guide bars. Preferably all of the guides of both guide bars are so threaded. The use of a plurality of elastic strands in each guide bar has the advantage of producing at higher rates and at lower costs a more compact fabric with more ends for feeding to the next operation. A further advantage from such threading is obtained especially when fine elastic strands (e.g., 22 dtex to 310 dtex) are used. The fine strands can be combined to correspond to a much thicker yarn (e.g., 1880 dtex) and consequently the same ease of unravelling and good splittability of the supply packages of the invention made with heavier elastic monofilaments are obtained with the fine thread. In addition, the unravelled fine threads are readily separable into individual strands which can be readily supplied to the subsequent fabric-making operations.

In another embodiment of the present invention the warp-knit supply package has nonknit portions of elastic yarns hanging out of both ends of the package. This permits continuous feeding of the subsequent fabric-making machine by tying the corresponding ends of supply packages together. This, of course, is not possible if the supply package has nonknit yarn ends extending from only one end of the package.

The knit construction of a particularly preferred supply package of the present invention is depicted in FIG. 2. The lap diagrams for each guide bar are shown on the right of FIG. 2; a diagram combining the stitches of both guide bars is shown on the left. Both guide bars are fully threaded. The back guide bar forms open one-needle pillar stitches (i.e., the 2-0, 0-2 stitch "B" of FIG. 1) and the front guide bar forms a closed 1 and 1 lap (i.e., the 2-4, 2-0 stitch "L" of FIG. 1). This particular elastic yarn supply package combines easy splitting and unravelling in a compact knit structure.

All known elastic threads may be used as the material for the production of the warp-knit supply packages of the present invention. Spandex filaments are preferred. The yarns may be processed in a covered or uncovered form.

What is claimed is:

1. An improved elastic thread supply package in the form of a double-face, two thread-system, warp-knit tape from which elastic threads may be unravelled and wherein the repeating stitch pattern from each thread system is no more than two wales wide, the improvement comprising for ease of splitting the package into narrower tapes, the stitch patterns from each bar having underlaps which form no crossovers between adjacent wales.

2. The supply package of claim 1 wherein the repeating stitch unit is repeated within every two courses and the underlaps of the two thread systems do not run in opposite directions.

3. The supply package of claim 1 wherein the repeating stitch unit is an open one-needle pillar stitch in one thread system and a closed 1 and 1 lap in the other thread system.

4. The supply package of claim 3 wherein the non-tensioned length of the elastic thread in each stitch is substantially equal.

5. The supply package of any preceding claim wherein each end in at least one of the thread systems consists of a plurality of low denier spandex strands.

6. An improved process for making an elastic yarn supply package wherein elastic yarns are warp-knit on a two needle-bar machine having at least two fully threaded guide bars which are controlled to form basic stitch patterns of no more than two needle-spaces wide, the improvement comprising further controlling the movement of the guide bars so that underlaps of the stitches from the different guide bars do not cross each other.

7. The process of claim 6 wherein each guide of at least one of the guide bars is threaded with two or more low denier spandex strands.

8. The process of claims 6 or 7 wherein one guide bar is controlled to form an open one-needle pillar stitch and the other guide bar is controlled to form a closed 1 and 1 lap.

* * * * *